United States Patent [19]

Stahlecker et al.

[11] Patent Number: 4,858,420

[45] Date of Patent: Aug. 22, 1989

[54] PNEUMATIC FALSE-TWIST SPINNING PROCESS AND APPARATUS

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 97,658

[22] Filed: Sep. 16, 1987

[30] Foreign Application Priority Data

Sep. 16, 1986 [DE] Fed. Rep. of Germany ..... 3631400

[51] Int. Cl.[4] ..... D01H 5/28; D01H 1/00; D02G 1/04; D02G 1/16

[52] U.S. Cl. ..... 57/328; 57/333; 57/350; 57/352

[58] Field of Search ..... 57/5, 6, 224, 328, 333, 57/350, 352

[56] References Cited

U.S. PATENT DOCUMENTS

| | | | |
|---|---|---|---|
| 3,822,543 | 7/1924 | Edagawa et al. | 57/328 X |
| 4,569,197 | 2/1986 | Arahara et al. | 57/328 |
| 4,621,490 | 11/1986 | Kawabata et al. | 57/328 |

FOREIGN PATENT DOCUMENTS

| | | |
|---|---|---|
| 57876 | 8/1982 | European Pat. Off. . |
| 94802 | 11/1983 | European Pat. Off. . |
| 121602 | 10/1984 | European Pat. Off. . |
| 2042387 | 4/1972 | Fed. Rep. of Germany . |
| 2330410 | 1/1975 | Fed. Rep. of Germany . |
| 2741690 | 3/1979 | Fed. Rep. of Germany . |
| 2424769 | 12/1979 | Fed. Rep. of Germany . |
| 3325699 | 2/1984 | Fed. Rep. of Germany . |
| 3519887 | 12/1985 | Fed. Rep. of Germany . |
| 52-55737 | 5/1977 | Japan . |
| 59-112035 | 6/1984 | Japan . |

*Primary Examiner*—John Petrakes
*Attorney, Agent, or Firm*—Barnes & Thornburg

[57] ABSTRACT

In the case of a process and an arrangement for pneumatic false-twist spinning having at least one pneumatic false-twist nozzle arranged between a drafting roller device and a withdrawal device, it is provided that the reversing of the twist applied to the sliver by the false-twisting nozzle is at least partially prevented and that fiber ends are spread away from the sliver in the area having an at least reduced twist. In certain embodiments, it is provided that the sliver is only prestrengthened by means of the false-twist spinning and is finished by a subsequent spinning or twisting process.

33 Claims, 3 Drawing Sheets

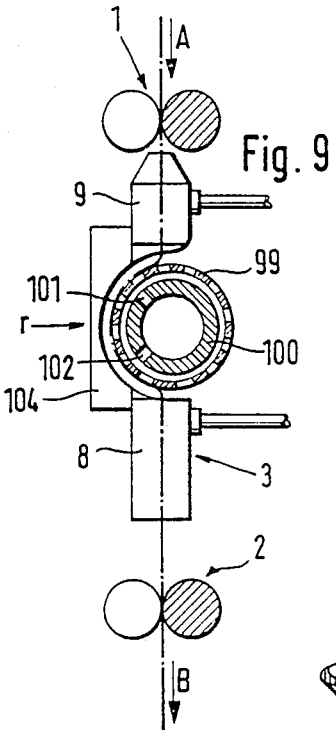
Fig. 9
Fig. 10
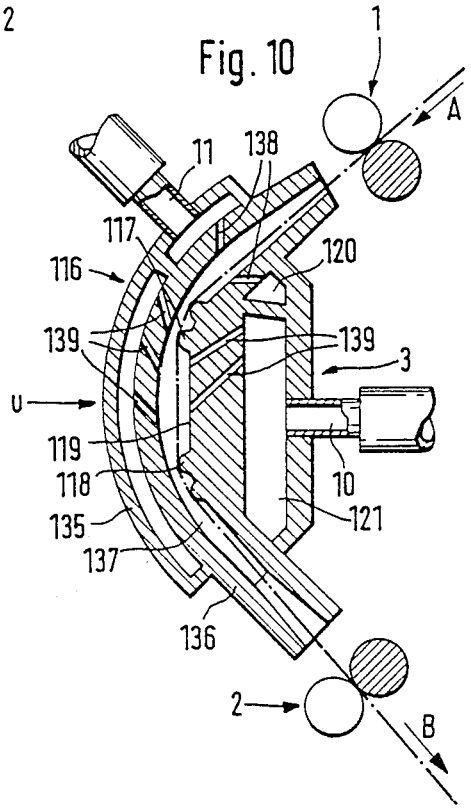

PNEUMATIC FALSE-TWIST SPINNING PROCESS AND APPARATUS

BACKGROUND AND SUMMARY OF THE INVENTION

The invention relates to a process and an arrangement for pneumatic false-twist spinning having at least one pneumatic false-twisting nozzle arranged between a drafting roller device and a withdrawal device.

In the case of pneumatic false-twist spinning, a false twist is forced on a sliver in the false twisting nozzle, which sliver has been drawn in a drafting roller device to a desired yarn size. After the passage through the false-twisting nozzle, this false twist that was forced onto the sliver opens up again, in which case, however, fibers located in the edge area that are anchored with only one end in the sliver, remain wound around this fiber connection. In order to carry out the false-twist spinning, a variety of arrangements have become known, exemplary disclosures being contained in the following patent applications: European Patent applications (EP) Nos. A 57 876, A 94 802 and A 121 602; Japanese applications (JP) Nos. OS 52-55 737 and OS 59-112 035, and German Published Unexamined Patent Applications (DE-OS) Nos. 20 42 387, 23 30 410, 24 24 769, 27 41 690, 33 25 699, and 35 19 887. However, all these known arrangements are unsatisfactory for a practical application at least to the extent that their realm of application is very limited.

The invention is based on the objective of opening up a larger area of application to pneumatic false-twist spinning and in particular, making it applicable also to longer and coarser fibers.

This objective is achieved according to the invention by at least partially reducing the effective twist that was applied to the sliver by the false-twisting nozzle, and by the spreading-away of fiber ends from the sliver in at least the area that has a reduced twist.

The invention is based on the basic idea that, for successful false-twist spinning, it should be endeavored to spread away from the sliver as many fiber ends as possible that will then be available for a winding-around. In this case it should mainly also be endeavored that the spread-away fiber ends that are available for a winding-around are distributed as evenly as possible over the length of the sliver because only then an even distribution of strength is possible that leads to a high overall yarn stability. The known arrangements meet these requirements only insufficiently. Although it is known from European Patent Application (EP) No. A 57 876 to connect means in front of the false-twisting nozzle that have the purpose of promoting a spreading-away of fiber ends, in this arrangement, the twist that is applied to the sliver is reversed into these means. The sliver in this area forms a yarn balloon, so that the contact with the means for the spreading-away of the fiber ends is uneven and the fiber ends can be spread-away only in a corespondingly uneven way. It is also known from European Patent Application (EP) No. A 94 802; and German Published Unexamined Patent Application (DE-OS) No. 33 25 699) to avoid or to reduce the reversing of the false twist that was applied to the sliver by the false-twisting nozzle by means of a special development of the inlet area of the false-twisting nozzle. Although as a result, the possibility of the spreading-away of fiber ends in the area located in front is improved, the spreading-away itself is still largely left to chance, so that also by means of this arrangement, no uniform yarn can be produced, particularly in the case of longer fiber lengths.

In a further development of certain preferred embodiments of the invention, it is provided that the sliver is only prestrengthened by the false-twist spinning and after passing through the withdrawal device is finished by a subsequent spinning or twisting process. In the case of this development, the produced yarn receives from the false-twist spinning only a part of the strength required for its further use. The remaining part is generated by a subsequent processing of the only prestrengthened sliver. In this case, it is important that the areas of the false-twist spinning and of the subsequent further treatment of the prestrengthened sliver are separated from one another by the withdrawal device, so that particularly a reactive effect of the subsequent treatment on the area of the false-twist spinning is avoided. It was found that in the case of this type of development, the requirements are lower that must be established with respect to the uniformity of the spread-away fiber ends. If the strengthening of the sliver that can be achieved by the false-twist nozzle is utilized only partly, a clearly more uniform yarn is obtained, also where there is no completely even distribution of the spread-away fiber ends relative to the length.

Other objects, advantages and novel features of the present invention will become apparent from the following detailed description of the invention when considered in conjunction with the accompanying drawings.

BRIEF DESCRIPTION OF THE DRAWINGS

FIG. 9 is a schematic view of a spinning unit arrangement constructed in accordance with an eighth preferred embodiment of the invention which has an air nozzle and a false-twisting nozzle connected behind it, between which a sieve drum is arranged as the deflecting element; and FIG. 10 is a schematic view of a spinning unit arrangement constructed in accordance with a ninth preferred embodiment of the invention which has a false-twisting nozzle that is developed as a curved nozzle.

DETAILED DESCRIPTION OF THE DRAWINGS

Figure 1:
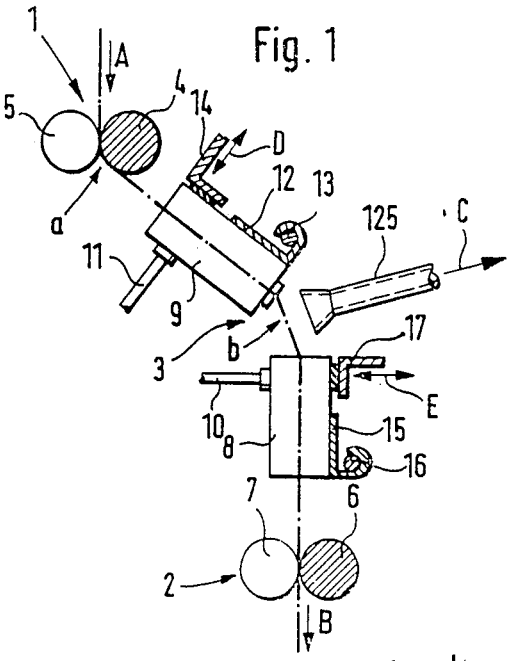
FIG. 1 is a schematic sectional view of a spinning unit arrangement constructed in accordance with a preferred embodiment of the invention which has an air nozzle that is connected in front of the false-twisting nozzle, in which case, by means of the arrangement of the air nozzles, a multiply deflected path of the yarn is obtained.

In all embodiments that are explained in the following, a drafting roller device 1 of conventional construction is provided, of which only the pair of delivery rollers 4, 5 is shown. In this drafting roller device 1, a sliver (A) is fed and drawn or drafted to the desired yarn size. One roller of each pair of rollers of this drafting roller device 1, i.e., the roller 4 of the pair of delivery rollers 4, 5, is developed as a driven bottom cylinder that passes through in longitudinal direction of the machine and to which the individual top rollers are assigned that are developed as pressure rollers, i.e., roller 5 of the pair of delivery rollers 4, 5. It will be understood that a plurality of similar side by side spinning units are arranged in preferred practical commercial constructions, with common drives and the like.

Each of the illustrated and described embodiments also contains a false-twisting zone 3 behind which a withdrawal device 2 is connected that comprises a pair of withdrawal rollers 6, 7, of which withdrawal roller 6 is formed as a cylinder passing through in the longitudinal direction of the machine, and withdrawal rollers 7 are each developed as respective pressure rollers. The withdrawal speed of the withdrawal device 2 is adapted to the delivery speed of the pair of delivery rollers 4, 5 of the drafting roller device 1 in such a way that a favorable false-twisting effect is achieved in the false-twisting zone 3. Since in this case, a shortening of the sliver (A) occurs, the withdrawal speed of the withdrawal device 2 is less so that a negative drawing exists in the area of the false-twisting zone 3.

When in the false-twisting zone 3 the sliver (A) is strengthened by means of the winding-around of outer fibers to such an extent according to certain preferred embodiments that a yarn (B) is delivered by the withdrawal device 2 that has sufficient strength for further use, a conventionally developed wind-up device being connected behind the withdrawal device 2 by means of which the yarn (B) is wound onto a spool. In other contemplated preferred embodiments only a prestrengthening is supplied to the sliver (A) in the false-twisting zone 3, and it is provided that the prestrengthened yarn (B) receives a final strengthening by means of a real twist, for example, by ring spinning, or by twisting-together or by means of a wound-around yarn. In this case, the prestrengthened yarn (B) will move to a ring spindle or to a wind-around spindle. For a twisting-together, two prestrengthened yarns (B) are guided together that will then be jointly wound onto a spool. These jointly wound-up yarns (B) are subsequently subjected to a twisting process in a twisting arrangement.

In the case of the embodiment according to FIG. 1, an air nozzle 9 and a false-twisting nozzle 8 are arranged between the drafting roller device 1 and the withdrawal device 2. The air nozzle 9 that is developed as a so-called injector nozzle and is acted upon by compressed air via a compressed-air supply line 11, generates an air current that is directed essentially in the moving or travel direction of the yarn, while the sliver (A) does not receive any significant twist. The air nozzle 9 is arranged at an angle with respect to the moving direction of the yarn in the drafting roller device 1 so that the sliver (A) winds around the delivery roller 4 over a part of its circumference and forms a deflecting point a. The false-twisting nozzle 8 that is connected to a compressed-air source via a compressed-air line 10, is arranged at an angle with respect to the air nozzle 9 so that a deflection b exists in the area between the false-twisting nozzle 8 and the air nozzle 9. In the area of the deflection b, a suction nozzle 125 is directed at the sliver (A) that is connected to a vacuum source that is not shown and that generates a suction air flow in the direction of the Arrow C. The sliver A, in the area of the deflection b is guided around an edge at the outlet of the air nozzle 9 and around an edge at the inlet of the false-twisting nozzle 8.

In the case of the embodiment according to FIG. 1, the effective false twist supplied to the sliver (A) by means of the false-twisting nozzle 8 and propogated in the direction toward the drafting roller device 1 is largely reduced by the edge at the inlet of the false-twisting nozzle 8. A further reduction takes place in the area of the deflecting edge at the outlet of the air nozzle 9 so that the sliver (A) in the area of the pair of delivery rollers 4, 5 has practically no twist. By means of the deflection a in the area of the pair of delivery rollers 4, 5, a spreading-away or separation of loose fiber ends from the sliver (A) is already made possible. This spreading-away is again promoted or repeated in the area of the deflecting edge at the outlet of the air nozzle 9. The suction air flow of the suction nozzle 125 that is effective in this area further promotes the spreading-away of loose fiber ends. Thus a sliver (A) is obtained, in the case of which an even distribution of spread-away fibers exists at the inlet into the false-twisting nozzle 8 relative to the length.

In order to, in the case of the embodiment according to FIG. 1, be able to adjust the effect with respect to the effective false twist and with respect to the spreading-away of the fiber ends, it is provided that the angular position of the air nozzle 9 as well as of the false-twisting nozzle 8 can be adjusted. The false-twisting nozzle 8 is disposed by means of a holding bracket 12 that can be swivelled around a stationary shaft 13 and is held at a stop 14 by means of spring force or magnetic force. The stop 14 can be adjusted in the direction of the double arrow D. The position of the stationary shaft 13 is shown in FIG. 1 only as an example. In order to be able to adjust the winding-around of the sliver (A) in the area of the delivery roller 4, it is provided in the case of a modified embodiment that the shaft 13 extends coaxially with respect to the delivery roller 4. The false-twisting nozzle 8, by means of a holding device 15, can be swivelled around a stationary shaft 16. Its position is determined by a holding bracket 17 that can be adjusted in the direction of the double arrow (E) and at which the false-twisting nozzle 8 is held by means of spring force or magnetic force. In addition, it is provided that the position of the suction nozzle 125 and/or the vacuum that can be connected to it are adjustable.

Figure 2:
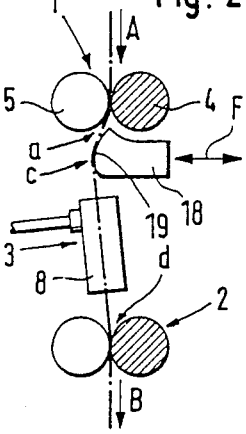
FIG. 2 is a schematic view of a spinning unit arrangement constructed in accordance with a second preferred embodiment of the invention which has a deflecting element between the drafting roller device and the false-twisting nozzle that is arranged diagonally with respect to a straight-line connection between the drafting roller device and the withdrawal device.

In the case of the embodiment according to FIG. 2, a false-twisting nozzle 8 is arranged in the false-twisting zone 3 between the drafting roller device 1 and the withdrawal device 2, a mechanical deflecting element in the shape of a skid 18 being connected in front of the false-twisting nozzle and being adjustable in the direction of the Double Arrow (F) and projecting with a deflecting surface 19 into the yarn path of the sliver A. The deflecting surface 19 has an outer surface that is arched in the moving direction of the yarn as well as an outer surface that is also arched transversely to it. The yarn deflecting surface 19 advantageously is also provided with a groove-shaped profiling, for example, corresponding to the groove-shaped profiling 24 of the embodiment according to FIG. 3*a*. This groove-shaped profiling 24 that moves apart in the moving direction of the yarn has the purpose of pulling apart the sliver (A) transversely to its moving direction. The false-twisting nozzle 8 is arranged in such a way that the sliver (A) moves through it in a straight line; i.e., the false-twisting nozzle 8 is slightly adjusted with respect to the moving direction of the sliver (A) in the drafting roller device 1.

In the case of the embodiment according to FIG. 2, a yarn deflection c is first obtained that has the effect of a twist brake and that at least partially limits the effective false twist supplied to the sliver (A) by the false-twisting nozzle 8, in the direction of the drafting roller device 1. Because of its shape, the deflecting surface 19 also results in a spreading-away of the fiber ends. A further deflection of the yarn exists in the area of the delivery roller 5 around which the sliver (A) is wound to a slight degree. A further yarn deflection d is located in the area of the withdrawal device 2. By the adjusting of the skid 18, by means of which the false-twisting nozzle 8 is advantageously adjusted synchronously, the effect of the skid 18 can also be adjusted with respect to the limitation of the false twist and with respect to the spreading-away of fiber ends. In particular, the spreading-away of fiber ends in the area of the deflecting surface 19 can also be promoted by a coating that is applied to said deflecting surface 19, said coating also reducing wear. In particular, a relatively coarse-grained surface promotes the spreading-away of the fibers ends.

Figure 3A:
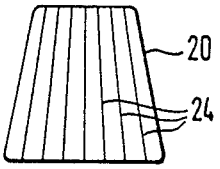
FIGS. 3*a* and 3*b* are enlarged schematic views depicting deflecting elements for use in arrangements corresponding to FIG. 2.
Figure 3B:
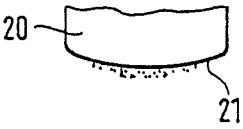

Instead of the skid 18, a skid 20 according to FIGS. 3*a, b* may also be used. The deflecting surface 21 of the skid 20 has a shape FIG. 3*b* that is arched transversely to the moving direction of the yarn. In moving direction of the yarn, it is provided with a groove-shaped profiling (FIG. 3*a*).

Figure 4A:
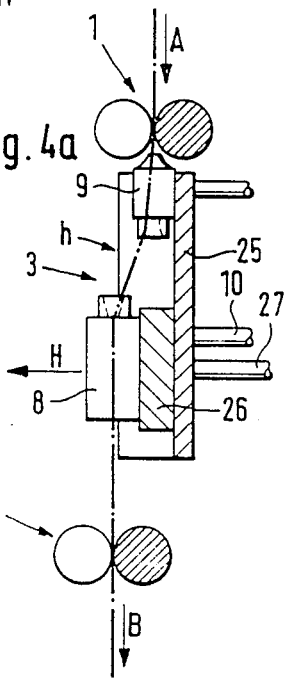
FIG. 4*a* is a schematic view of a spinning unit arrangement constructed in accordance with a third preferred embodiment of the invention which has a false-twisting nozzle and an air nozzle arranged in parallel, but offset with respect to one another.

In the case of the embodiment according to FIG. 4*a*, an air nozzle 9 and a false-twisting nozzle 8 are arranged between the drafting roller device 1 and the withdrawal device 2 in the area of the false-twisting zone 3. The passage direction through the air nozzle 9 extends in parallel to the passage direction through the false-twisting nozzle 8 which, however, in moving direction of the yarn, is arranged to be laterally offset with respect to the air nozzle 9 so that a deflection (h) is obtained between the outlet of the air nozzle 9 and the inlet of the false-twisting nozzle 8. As shown in FIG. 4*a*, the drafting roller device 1 and the withdrawal device 2 are also correspondingly offset with respect to one another so that the sliver (A) in each case moves through the air nozzle 9 and through the false-twisting nozzle 8 in a straight line. The sliver (A) in this case is deflected at the outlet of the air nozzle 9 as well as at the inlet of the false-twisting nozzle 8. The deflection at the inlet of the false-twisting nozzle 8 is used essentially as the means for limiting the false twist in the direction of the air nozzle 9, while the deflection at the outlet of the air nozzle 9 is used essentially for the spreading-away of the fiber ends.

Figure 4B:
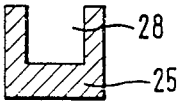
FIGS. 4*b* and 4*c* are enlarged schematic views showing parts of the FIG. 4*a* arrangement.
Figure 4C:
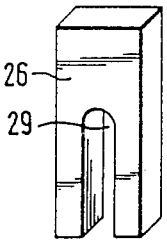

As further shown in FIGS. 4*a* and 4*b*, an essentially U-shaped holding bracket 25 is provided in which the air nozzle 9 as well as the false-twisting nozzle 8 are arranged. In this case, the air nozzle 9 is arranged in a stationary way and the false-twisting nozzle 8 is arranged so that it can be adjusted in the direction of the Arrow H. For the adjusting, selectively replaceable pads 26 (FIG. 4*c*) can be inserted between the web of the U-shaped holding bracket 25, i.e., on the groove base 28 formed by it, and the false-twisting nozzle 8, said pads having different thicknesses. The pads 26 are provided with a longitudinal slot 29, by means of which they may be fitted onto a guiding stop 27 and onto the compressed-air line 10 leading to the false-twisting nozzle 8. The compressed-air line 10 and/or the stop 27 are developed in such a way that at them, the position of the false-twisting nozzle 8 can be fixed in the direction of the Arrow (H) with respect to the holding bracket 25. As a rule, the differences in the adjustment of the false-twisting nozzle 8, i.e., the differences in the thicknesses of the pads 26, are just large enough so that the straight course of the sliver (A) in the false-twisting nozzle 8 is not interfered with. Should, however, larger variations be required and it is to be prevented at the same time that the sliver (A) runs against the outlet of the false-twisting nozzle 8, it is provided in a development of the embodiment according to FIG. 4*a* that at a distance to the outlet of the false-twisting nozzle 8, a yarn guide is mounted that also adjusts the sliver (A) in the case of a change of the adjustment of the position of the false-twisting nozzle 8.

As a modification of the embodiment according to FIG. 4*a*, it is provided in the case of another embodiment that the false-twisting nozzle 8 is mounted at the holding bracket 25 so that it can be adjusted in the moving direction of the yarn. As a result, it is possible to change the distance between the outlet of the air nozzle 9 and the inlet of the false-twisting nozzle 8 and correspondingly also the angle of the deflection h.

As also shown in FIG. 4*a*, the air nozzle 9, with an inlet tip, projects into the area of the wedge-shaped gap of the pair of delivery rollers of the drafting roller device 1. This tip, that contains the inlet opening, advantageously also extends in the axial direction of the pair of delivery rollers over the diameter of the air nozzle 9, so that an inlet opening is obtained in the shape of a flattened funnel. As a result, it is ensured that fiber loss in the area of the pair of delivery rollers is minimized.

Figure 5:
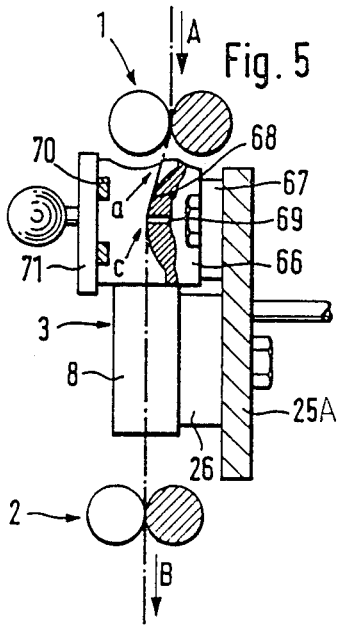
FIG. 5 is a schematic view of a spinning unit arrangement constructed in accordance with a fourth preferred embodiment of the invention which has a false-twisting nozzle that is arranged in an offset way with respect to the moving direction of the drafting roller device and a mechanical deflecting element that is connected between them.

In the case of the embodiment according to FIG. 5, a mechanical deflecting element 66 is connected in front of the false-twisting nozzle 8 that in the false-twisting zone 3 is arranged between a drafting roller device 1 and a withdrawal device 2, said deflecting element 66 connecting directly to the pair of delivery rollers. The mechanical deflecting element 66, on the one hand, forms a deflection a at the pair of delivery rollers and is also a deflection c itself. The deflecting element 66 has a deflecting surface 68 of a shape that is convexly arched in moving direction of the yarn. In addition, profilings or the like may also be provided on the deflecting surface, by means of which a spreading-apart of the sliver (A) is achieved, while, at the same time, the effective false twist is at least limited. Reference is made in this connection to the skids 18 and 20 according to FIGS. 2 and 3. In the area of the deflecting surface 68, in a way that is only schematically shown, a blowhole 69 is provided that is connected to a compressed-air source, by means of which, in particular, a softly blown current is blown at the sliver (A) by means of which the spreading-away effect can be enhanced. The deflecting surface 68 of the deflecting element 66 is limited by two lateral walls so that a U-shaped duct is created. This U-shaped duct is closed off by a lid 71 that is secured by means of magnets 70 mounted at the lateral walls.

The deflecting element 66 of FIG. 5, as a whole, is exchangeable and can be exchanged for others having a different deflecting surface and/or height. In addition, it is possible to adjust the size of the deflection by the deflecting element by means of pads 67 that are mounted between the deflecting element 66 and a holding bracket 25A. The deflecting element 66 is mounted at the holding bracket 25A, for example, by means of a screw. In the case of a modified embodiment that is similar to FIG. 5, the deflecting element 66 is equipped with several ribs that extend in parallel to one another and essentially transversely to the moving direction of the yarn. The rib that is closest to the false-twisting nozzle 8 is then used essentially as the means for reducing the false twist supplied to the sliver A, while the preceding rib or ribs essentially have the function of the spreading-away of the fiber ends.

Figure 6:
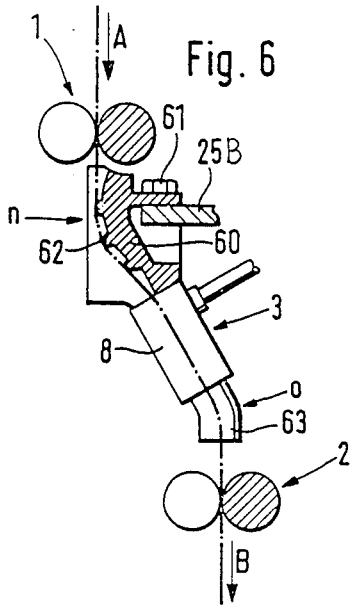
FIG. 6 is a schematic view of a spinning unit arrangement constructed in accordance with a fifth preferred embodiment of the invention which has a deflecting element that has several ribs connected in front of a false-twisting nozzle that is arranged diagonally with respect to the yarn path of the drafting roller device.
Figure 7A:
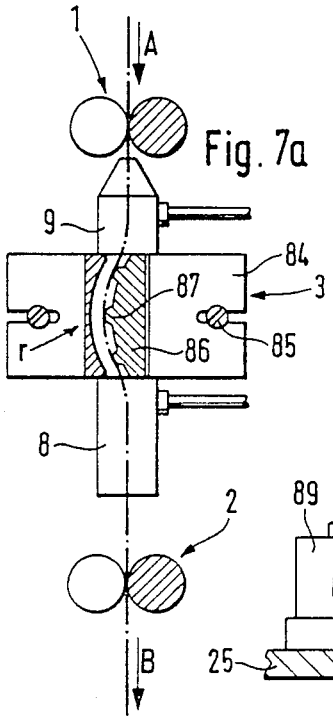
FIG. 7*a* is a schematic view of a spinning unit arrangement constructed in accordance with a sixth preferred embodiment of the invention which has a deflecting element with several ribs located between a false-twisting nozzle and an air nozzle.
Figure 7B:
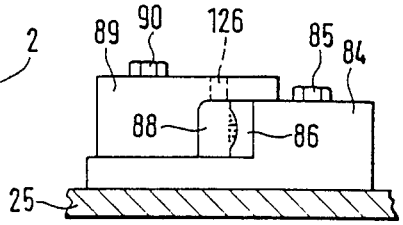
FIG. 7*b* is an enlarged schematic view of a portion of the FIG. 7*a* arrangement.

In the case of the embodiment according to FIG. 6, a false-twisting nozzle 8 is arranged in the false-twisting zone 3 that is directed diagonally with respect to the sliver (A) in the preceding drafting roller device 1. Between the false-twisting nozzle 8 and the pair of delivery rollers of the drafting roller device 1, a mechanical deflecting element 60 is arranged that is mounted by means of a screw 61 at a holding bracket 25 and that is equipped with several ribs 62 extending essentially transversely to the yarn path and being parallel with respect to one another, said ribs 62 together determining an arched path of the yarn between the pair of delivery rollers of the drafting roller device 1 and the inlet of the false-twisting nozzle 8. This path of the yarn is closed off by means of lateral walls delimiting the ribs 62 that, with the basic body of the deflecting element 60, form an approximately U-shaped duct. The ribs 62 that preferably have a semicylindrical shape and a smooth surface, in each case, cause a part of one deflection of the overall deflection n. The first rib 62 that faces the false-twisting nozzle 8 has a higher effect on the reduction of the false twist, while the rib 62 that is disposed closest to the drafting roller device 1 has a higher effect on the spreading-away of fibers. As a modification of the shown embodiment, it is provided that the ribs 62 are adjusted at an angle diagonally with respect to the moving direction of the yarn, said angle corresponding to the later winding-around direction of the fiber ends.

The deflecting element 60 of the embodiment according to FIG. 6 is mounted at the holding bracket 25B so that on one hand it can be adjusted transversely to the moving direction of the yarn. On the other hand, deflecting element 60 may also be exchanged in a simple way for a differently dimensioned deflecting element 60 that is also equipped with ribs 62, in order to influence the effects concerning the reduction of the effective twist and of the spreading-away of the fiber ends. The false-twisting nozzle 8 is advantageously also held by a holding bracket so that it can be adjusted with the deflecting element 60 and so that the inlet angle of the sliver (A) by means of which said sliver (A) enters into the false-twisting nozzle 8 does not change. A pipe piece 63 forming a yarn deflection (o) connects to the false-twisting nozzle 8 on the side facing the withdrawal device 2.

FIGS. *7a* and *7b* show an embodiment in which the air nozzle 9 and the false-twisting nozzle 8 are arranged in alignment behind one another. Between the false-twisting nozzle 8 and the air nozzle 9, a deflecting element 86 is arranged that is equipped with several ribs 87 that are arranged essentially transversely to the movement of the yarn and that are located on a curve and that all, with their outer circumference, project into the path of the yarn. The deflecting element 86 is constructed as an insert made of a hardened material such as porcelain or a ceramic material and, in an easily exchangeable way, is mounted at a holding device 84. The holding device 84 can be shifted transversely with respect to the path of the yarn in such a way that the ribs 87 project more or less extensively into the path of the yarn. The holding device 84, in this direction, is provided with longitudinal slots that are penetrated by locking screws 85. The area of the insert 86 is closed by means of a lid 89 that is fastened by means of one or several screws 90 at the holding device 84 and that, together with the insert 86, forms a guiding duct 88 that is closed on all sides. As shown in FIG. 76, bores 126 can be provided in the lid 89 in order to Permit the escaping of the outgoing air of the air nozzle 9.

In the case of the embodiment according to FIGS. *7a*, *7b* in addition to the deflection (r) formed by the insert 86, deflections are formed at the outlet of the air nozzle 9 and at the inlet of the false-twisting nozzle 8. If it is to be provided that deflections for the sliver (A) exist neither at the outlet of the air nozzle 9, nor at the inlet of the false-twisting nozzle 8, it may be provided that additional guiding elements are located at the start and at the end of the deflecting element 86 that take over this deflection, such as rings. In this case, it is also possible to arrange the outlet of the air nozzle 9 and/or the inlet of the false-twisting nozzle 8 at a distance to the deflecting element 86.

Figure 8:
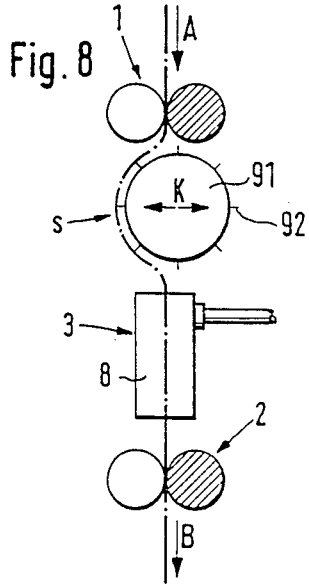
FIG. 8 is a schematic view of a spinning unit arrangement constructed in accordance with a seventh preferred embodiment of the invention which has a deflecting element that is developed as a needle roller.

In the case of the embodiment according to FIG. 8, a false-twisting nozzle 8 is arranged in the false-twisting zone 3 located between a drafting roller device 1 and a withdrawal device 2. A needle roller 91 is connected in front of said false-twisting nozzle 8. The circumference of the needle roller 91 is equipped with a mounting or with needles 92. The rotating shaft of the needle roller 91 that is driven to perform at a circumferential speed that corresponds to the circumferential speed of the pair of delivery rollers of the drafting roller device 1, extends in parallel to the shafts of the pair of delivery rollers of the drafting roller device 1. The needle roller 91, which may also be called a porcupine roller, can also be equipped with a different mounting, for example, with a mounting of teeth or grooves or ribs.

In the case of the embodiment shown in FIG. 8, the shaft of the needle roller 91 is located approximately in the straight-line connection between the pair of delivery rollers of the drafting roller device 1 and the false-twisting nozzle 8. The needle roller 91 therefore forms a deflection (s) with about half of its circumference to which other deflections are added in the area of the pair of delivery rollers of the drafting roller device 1 and of the inlet of the false-twisting nozzle 8. The needle roller 91 is arranged so that it can be adjusted by means of holding elements transversely to the moving direction of the yarn in the direction of the Double Arrow K, so that the size of the deflections can be adjusted. The needle roller 91 in this case in the area facing the false-twisting nozzle 8 has the function of a twist blocking means, whereas in the preceding area, because of the deflection (s) an effect is obtained that promotes the spreading-away of the fiber ends. By means of the adjusting of the needle roller 91, these effects can be optimally coordinated.

As a modification of the embodiment according to FIG. 8, it is provided that the false-twisting nozzle 8 is aligned tangentially with respect to the needle roller 91 so that in the area of its inlet, no deflection of the sliver (A) takes place. In a further modification, it is provided that the needle roller 91 in addition is arranged with its shaft in such a way that also the delivery direction of the drafting roller device 1 extends approximately tangentially with respect to the needle roller 21 so that then no deflection by means of a winding-around one of the delivery rollers takes place at the delivery rollers of the drafting roller device 1. In a further embodiment, it is provided that the needle roller 91 is driven in such a way that a speed difference of its mounting 92 exists with respect to the circumferential speed of the pair of delivery rollers of the drafting roller device 1, i.e., with respect to the supply speed of the sliver A, so that a positive or negative drafting is obtained between the pair of delivery rollers and the needle roller 91. The withdrawal speed of the withdrawal device 2 is in all cases coordinated with the needle roller 91 in such a way that a negative drafting exists in the area of the false-twisting nozzle 8.

In the case of the embodiment according to FIG. 9, an air nozzle 9 that acts essentially as an injector nozzle, and a false-twisting nozzle 8 that is connected behind it are arranged in the false-twisting zone 3. Between the air nozzle 9 and the false-twisting nozzle 8, a sieve roller 99 is arranged as the deflecting element that is equipped with a suction insert 100 that is connected to a vacuum source that is not shown, and with suction slots 101, 102 is directed at the circumferential area of the sieve roller 9 carrying the sliver A. The sieve roller 99, in this area, is surrounded by a wall 104 that is adapted to its contour. The sieve roller 99 is driven in such a way that its circumferential speed corresponds to the delivery speed of the drafting roller device 1. In the case of a modified embodiment, it is provided that the sieve roller 99 is not driven but stands still, so that the sliver (A) slides on its perforated shell.

In the case of the embodiment according to FIG. 9, it is provided that the shaft of the sieve roller 99 is arranged approximately in the connecting line between the air nozzle 9 and the false-twisting nozzle 8 that are in alignment with one another so that a deflection (r) takes place at its circumference, in front of which a deflection is located at the outlet of the air nozzle 9 and behind which a deflection is located at the inlet of the false-twisting nozzle 8. In the case of a modified embodiment, it is provided that the false-twisting nozzle 8 is arranged in such a way that it is at least approximately tangentially aligned with the circumference of the sieve roller 99 so that no deflection of the sliver (A) takes place in the inlet area of the false-twist nozzle 8. In the case of another embodiment, it is, in addition or as an alternative, provided that the sieve roller 99 is arranged in such a way that the air nozzle 9 is aligned tangentially to its circumference.

In the case of the embodiment according to FIG. 10, a nozzle unit 116 is arranged in the area of the false-twisting zone 3 located between a drafting roller device 1 and a withdrawal device 2. Nozzle unit 116 comprises several portions and as a whole causes a curved course with a deflection (u) of almost 90° for the sliver A. The nozzle unit 116 has an outer housing 135 in which an insert 136 is arranged that forms the arched guiding duct 137 for the sliver A. The outer housing 135 is constructed in two parts in such a way that the insert 136 can be clamped between both parts of the outer housing 135. Between the outer housing 135 and the insert 136, a ring chamber is provided that is divided into two portions 120 and 121. Portion 121 is connected to a compressed-air supply line 10 and portion 120 is connected to a compressed-air supply line 11. The inlet portion of the guiding duct 137 is approximately tangentially assigned to the effective false circumferences of the pair of delivery rollers of the drafting roller device 1. In its end area, at least one injector bore 138 is provided that starts in portion 120 of the ring chamber and leads into the guiding duct 137. These injector bores 138 are sloped with a relatively steep slope in the moving direction of the sliver (A) so that in the area of the pair of delivery rollers, a suction flow is created. Several twisting bores 139 lead into a portion of the guiding duct 137 that follows and the exterior side of which is arched, which bores 39 lead in tangentially with respect to the duct portion and produce an air whirl. These twisting bores 139 also have a slope in the moving direction of the sliver A. Connected to this bent portion is another portion of the guiding duct 137 that extends essentially in a straight line and is directed approximately tangentially with respect to both withdrawal rollers of the withdrawal device 2. Between the individual portions of the guiding duct 137, deflecting elements are arranged in each case in the form of ribs 117 and 118 that are directed essentially transversely to the path of the yarn and project into the path of the yarn. In the shown embodiment, two ribs 117 and 118 are provided in each case. In other contemplated embodiments, more than two ribs are also arranged at the respective deflecting points between the portions of the guiding duct 137 which then are arranged in such a way on an arch that they all project into the path of the yarn. The ribs 117, 118 have a semicylindrical shape with a smooth surface. Instead of an arrangement in which they extend precisely transversely with respect to the yarn path of the sliver A, they may also be arranged with a slope with respect to it, particularly with a slope that corresponds to the twist applied to the sliver A.

As a modification of the embodiment shown in FIG. 10, it is provided that injector bores also lead into the portion of the guiding duct 137 hat follows the ribs 118, the injector bores coming from portion 121 of the ring chamber and also generating an air whirl in an indicated rotating direction. In the case of this embodiment, the ribs 118 will then act as means for at least reducing the reversing of the twist that is applied to the sliver (A) in the last portion of the guiding duct 137. In this case, it may be provided that the rotating direction of the air whirl in the area of the central portion of the guiding duct 137 is opposite to the rotating direction of the air whirl in the last portion. Particularly because of the effect of the ribs 118 as means for preventing the reversing of the twist, it may, however, also be provided that the rotating direction of the air whirls is the same in both portions.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A process for pneumatic false-twist spinning having one pneumatic false-twisting nozzle means including at least one pneumatic false-twist nozzle arranged between a sliver drafting device and a withdrawal device, said process comprising:

at least partially reducing propogation of the false twist applied to the sliver by the false-twisting nozzle means in the direction of the drafting device to form an area having reduced twist, and spreading away fiber ends from the sliver in at least the area having reduced twist utilizing spreading means disposed separate from and downstream of the most upstream portion of the area having reduced twist.

2. A process according to claim 1, wherein the sliver is only prestrengthened by means of the false-twisting nozzle means whereby the prestrengthened sliver formed thereby can be further finished in a subsequent spinning or twisting finishing process.

3. A process according to claim 2, comprising applying an actual twist by ring spinning the sliver that was prestrengthened by the false-twist spinning.

4. A process according to claim 2, comprising winding a binding yarn and particularly a filament yarn around the sliver that was prestrengthened by the false-twist spinning.

5. A process according to claim 2, comprising jointly winding up two slivers that were prestrengthened by the false-twist spinning and subsequently twisting them together.

6. An arrangement for false twist spinning comprising:

drafting means for drafting sliver to be spun, at least one pneumatic false-twisting nozzle for applying a false-twist to the sliver supplied from the drafting means, withdrawal means for withdrawing the sliver form the false-twisting nozzle, twist propogation reducing means disposed between the drafting means and the false-twisting nozzle and being operative to at least partially reduce propogation of the effective false-twist applied to the sliver by the false-twisting nozzle toward the drafting means to form an area having reduced twist, and fiber end spreading means for spreading away fiber ends from the silver at least in the area having reduced twist, said spreading means including means disposed separate from and downstream of the upstream most portion of the propogation reducing means.

7. An arrangement according to claim 6, wherein effect adjusting means are provided for adjusting the effect of at least one of the twist propogation reducing means and the fiber end spreading means.

8. An arrangement according to claim 6, wherein at least one other air nozzle is connected in front of the false-twisting nozzle, and wherein the travel path of the sliver between the false-twisting nozzle and the air nozzle receives at least one deflection, said at least one deflection serving as at least a part of at least one of the twist propagation reducing means and fiber end spreading means.

9. An arrangement according to claim 8, wherein at least one deflecting element is arranged between the air nozzle and the false-twisting nozzle.

10. An arrangement according to claim 8, wherein the false-twisting nozzle and the air nozzle are arranged at an angle with respect to one another.

11. An arrangement according to claim 8, wherein the false-twisting nozzle and the air nozzle are arranged in parallel to one another but offset in the moving direction of the yarn.

12. An arrangement according to claim 8, wherein a pneumatic deflecting element is arranged between the air nozzle and the false-twisting nozzle.

13. An arrangement according to claim 8, wherein a mechanical deflecting element is arranged between the air nozzle and the false-twisting nozzle.

14. An arrangement according to claim 8, wherein the at least one other air nozzle includes an air nozzle that follows the drafting means in the travel path of the yarn and is developed as an injector nozzle generating a conveying air current in the travel path of the yarn.

15. An arrangement according to claim 8, wherein two false-twisting nozzles are arranged behind one another, between which means are arranged for reducing the propogation of the twist applied to the sliver by the false-twisting nozzle that is second in the travel path of the yarn.

16. An arrangement according to claim 15, wherein adjusting means are provided for adjusting the relative position of at least one of the first false-twisting nozzle, the air nozzle, and the second false-twisting nozzle with respect to a next adjacent one of said nozzles.

17. An arrangement according to claim 8, wherein a duct-type guiding element is arranged between at least one other of the air nozzles and the false-twisting nozzle.

18. An arrangement according to claim 17, wherein at least one of the twist propogation reducing means and fiber end spreading means are disposed inside the duct-type guiding element for reducing propogation of the twist and/or for spreading the fiber ends.

19. An arrangement according to claim 8, wherein the false-twisting nozzle has a whirl duct that is curved around a shaft extending transversely to the moving direction of the yarn.

20. An arrangement according to claim 6, wherein a deflecting guide is provided at the end of the false-twisting nozzle, the deflecting guide serving as at least a portion of at least one of the twist propogation reducing means and the fiber end spreading means.

21. An arrangement according to claim 20, wherein ribs are arranged that project in the travel path of the yarn at the output of the false-twisting nozzle.

22. An arrangement according to claim 6, wherein at least one mechanical deflecting element for the sliver is provided as the means for reducing propogation of the twist and for the spreading-away of fiber ends.

23. An arrangement according to claim 22, wherein the deflecting element is provided with a surface shape for generating a force that spreads apart the sliver transversely with respect to the travel path of the yarn.

24. An arrangement according to claim 22, wherein several ribs that deflect the path of the yarn are arranged in front of the false-twisting nozzle.

25. An arrangement according to claim 24, wherein the ribs have an approximately semicylindrical smooth outer surface.

26. An arrangement according to claim 24, wherein the ribs extend in parallel to one another.

27. An arrangement according to claim 24, wherein the ribs are arranged so that they are sloped in the moving direction of the yarn.

28. An arrangement according to claim 22, wherein a needle roller is provided as the deflecting element.

29. An arrangement according to claim 22, wherein a roller provided with a mounting is provided as the deflecting element.

30. An arrangement according to claim 22, wherein a perforated roller is provided as the deflecting element to which means are assigned for generating an air current flowing through the shell of the roller.

31. An arrangement according to claim 6, wherein a ring spinning arrangement is arranged behind the withdrawal means.

32. An arrangement according to claim 6, wherein a wind-around spinning device is arranged behind the withdrawal means.

33. An arrangement according to claim 6, wherein means are arranged behind the withdrawal means for the guiding together of two slivers and for the joint winding-up of said slivers.

* * * * *